US006184664B1

(12) United States Patent
Ponzetta

(10) Patent No.: US 6,184,664 B1
(45) Date of Patent: Feb. 6, 2001

(54) VOLTAGE REGULATOR CIRCUIT FOR SUPPRESSING LATCH-UP PHENOMENON

(75) Inventor: Antonio Martino Ponzetta, Gampelen (CH)

(73) Assignee: EM Microelectronics-Marin SA, Marin (CH)

( * ) Notice: Under 35 U.S.C. 154(b), the term of this patent shall be extended for 0 days.

(21) Appl. No.: 09/423,228

(22) PCT Filed: May 11, 1998

(86) PCT No.: PCT/EP98/02749

§ 371 Date: Nov. 4, 1999

§ 102(e) Date: Nov. 4, 1999

(87) PCT Pub. No.: WO98/52111

PCT Pub. Date: Nov. 19, 1998

(30) Foreign Application Priority Data

May 12, 1997 (EP) ..... 97107722

(51) Int. Cl.[7] ..... G05F 1/40
(52) U.S. Cl. ..... 323/274; 323/280; 361/18
(58) Field of Search ..... 323/273, 274, 323/280, 281; 361/18

(56) References Cited

U.S. PATENT DOCUMENTS 3,217,237 * 11/1965 Giger .
5,177,429 * 1/1993 Eki ..... 323/281
5,212,616 5/1993 Dhong et al. ..... 361/18

FOREIGN PATENT DOCUMENTS 2 298 939 3/1996 (GB) ..... G05F/1/569

OTHER PUBLICATIONS

Prediger et al., "Bipolare Konstantstromquelle", vol. 42, No. 21, Oct. 19, 1993, p. 132/133.
Chambers, A.S., "Programmable D.C. Power Supplies", Industrial Electronics, Dec. 1968, pp. 480–483.
Vittoz et al., "CMOS Analog Integrated Circuits Based on Weak Inversion Operation", IEEE Jour. of Solid–State, vol. SC–12, No. 3, Jun. 1977, pp. 224–231.
Degrauwe et al., "CMOS Voltage References Using Lateral Bipolar Transistors", IEEE, Jour. of Solid–State, vol. SC–20, No. 6, Dec. 1985.

* cited by examiner

*Primary Examiner*—Jeffrey Sterrett
(74) *Attorney, Agent, or Firm*—Griffin & Szipl, P.C.

(57) ABSTRACT

A voltage regulator circuit (1) able to detect a latch-up phenomenon disturbing the voltage to be regulated, to suppress such phenomenon and re-establish the voltage at a predetermined level. The circuit a bipolar transistor (2), a resistor (5) and substantially constant voltage supply means (6). The circuit (1) also includes voltage detection means (11) arranged to receive the regulated voltage (Vreg), and to supply a control voltage to said transistor (2) which can control the switching thereof between a conducting state and a blocked state, so that the transistor (2) is in the blocked state when latch-up causes the regulated voltage to drop below a first voltage level, and so that the transistor (2) is in the conducting state when the regulated voltage is lower than a second voltage level, the latch-up being suppressed below such level.

5 Claims, 6 Drawing Sheets

Vref
Vr'
Vr''
31
33
32
Vreg'
Vreg''
A'' Vr''
A' Vr'
Vreg

VOLTAGE REGULATOR CIRCUIT FOR SUPPRESSING LATCH-UP PHENOMENON

FIELD OF THE INVENTION

The present invention concerns a voltage regulator circuit for regulating a voltage disturbed by a phenomenon known as <<latch-up>>.

BACKGROUND OF THE INVENTION

Numerous voltage regulator circuits exist in the prior art.

A circuit of this type is disclosed in GB Patent No. 2 298 939, and is shown in FIG. 1A of the present description. This circuit includes a control transistor Q1 connected in series between an input terminal I and an output terminal O, and an output voltage detector D formed of two resistors Ra and Rb connected in series between output terminal O and the circuit's earth.

A voltage corresponding to the output voltage detected by detector D is compared to a reference voltage E3 by an operational amplifier AO, and the output voltage thereof is applied to the base terminal of a transistor Q2. Thus a base current of control transistor Q1 can be controlled by the output voltage of operational amplifier AO, via transistor Q2, so that the impedance of control transistor Q1 is controlled so as to provide a predetermined voltage at output terminal O.

One problem encountered during the operation of such a circuit lies in the unintentional appearance of phenomena known as <<latch-up>>which occur in an electronic component of the circuit, following external disturbances such as the supply of an electric voltage, an electric current or radiation.

<<Latch-up>>is commonly used to designate any phenomenon occurring in an integrated circuit following external disturbances such as the supply of an electric voltage, an electric current or radiation.

Numerous devices exist in the prior art for detecting <<latch-up>>in a substrate and, in particular, devices analysing a current capable of being disturbed by said phenomenon.

A device of this type is disclosed in Japanese Patent Application No. 5 326 825 in the name of FUNAI ELECTRIC CO LTD, and is shown in FIG. 1B of the present description. This device includes an integrated circuit IC1 at a first terminal of which is provided a supply voltage Vdd, via a bipolar transistor T1, and at the second terminal of which is connected a resonant circuit formed of a resistor R3 and a capacitor C3. A detection integrated circuit IC2 includes an earth terminal, a first terminal at which is provided supply voltage Vdd, and a second terminal connected to said resonant circuit as well as to the base terminal of a bipolar transistor T2 via a resistor R2. The base terminal of transistor T1 is connected to the collector terminal of transistor T2 via a resistor R1, and the emitter terminal of transistor T2 is earthed.

In the device described hereinbefore in relation to FIG. 1B, if latch-up occurs, a significant drop in supply voltage Vdd is detected by integrated circuit IC2. In this case, transistors T1 and T2 are blocked, and the voltage supplying integrated circuit IC1 is interrupted, which initialises the circuit. Subsequently, integrated circuit IC1 again operates normally.

However, these devices have complex structures and require a large number of electronic components to perform the detection and regulator functions.

SUMMARY OF THE INVENTION

One object of the present invention is to provide a voltage regulator circuit intended to suppress any inadvertent latch-up phenomenon.

Another object of the present invention is to provide a circuit of this type which answers criteria as to cost and simplicity.

These objects, in addition to others are achieved by the voltage regulator circuit according to claim 1.

One advantage of the circuit according to the present invention is that it provides a voltage regulator circuit having a structure not very complex which makes it cheap.

Another advantage of the circuit according to the present invention is that it provides a circuit including voltage comparison means to the input of which is supplied the regulated voltage, these means being arranged so as to define two voltage thresholds capable of being predetermined to respond to the needs of the user.

These objects, features and advantages of the present invention, in addition to others will appear more clearly upon reading the detailed description of a preferred embodiment of the invention, given solely by way of example, with reference to the annexed drawings:

DESCRIPTION OF THE INVENTION

Figure 1A:
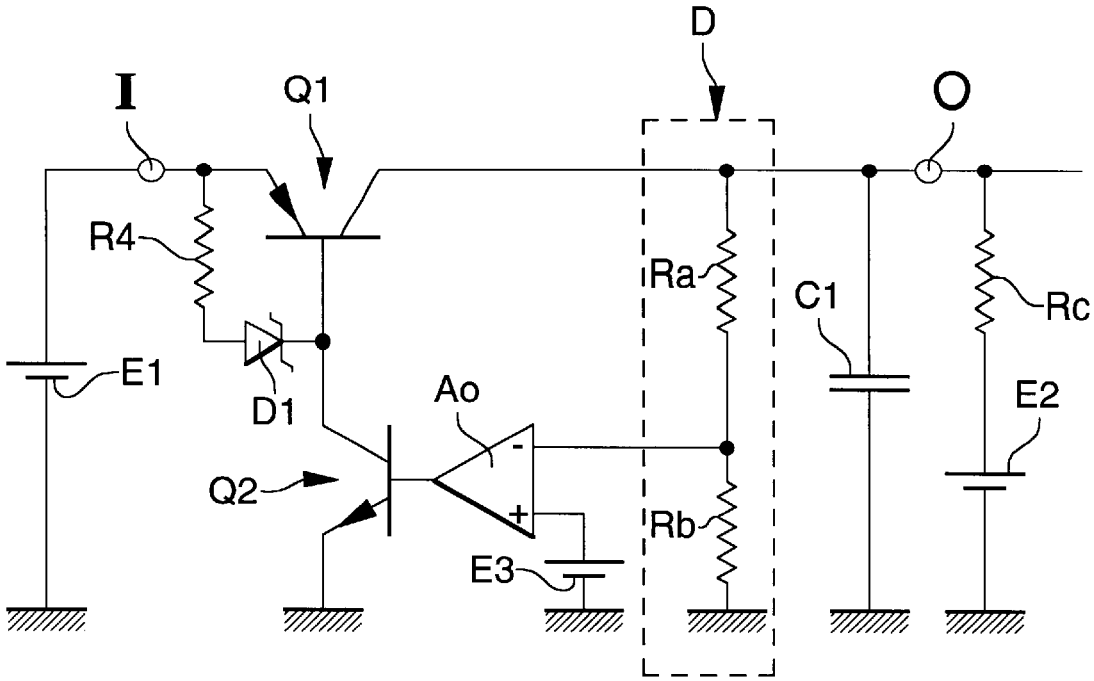
Fig. 1A ( PRIOR ART )
FIGS. 1A and 1B which have already been cited show two voltage regulator circuits according to the prior art.
Figure 1B:
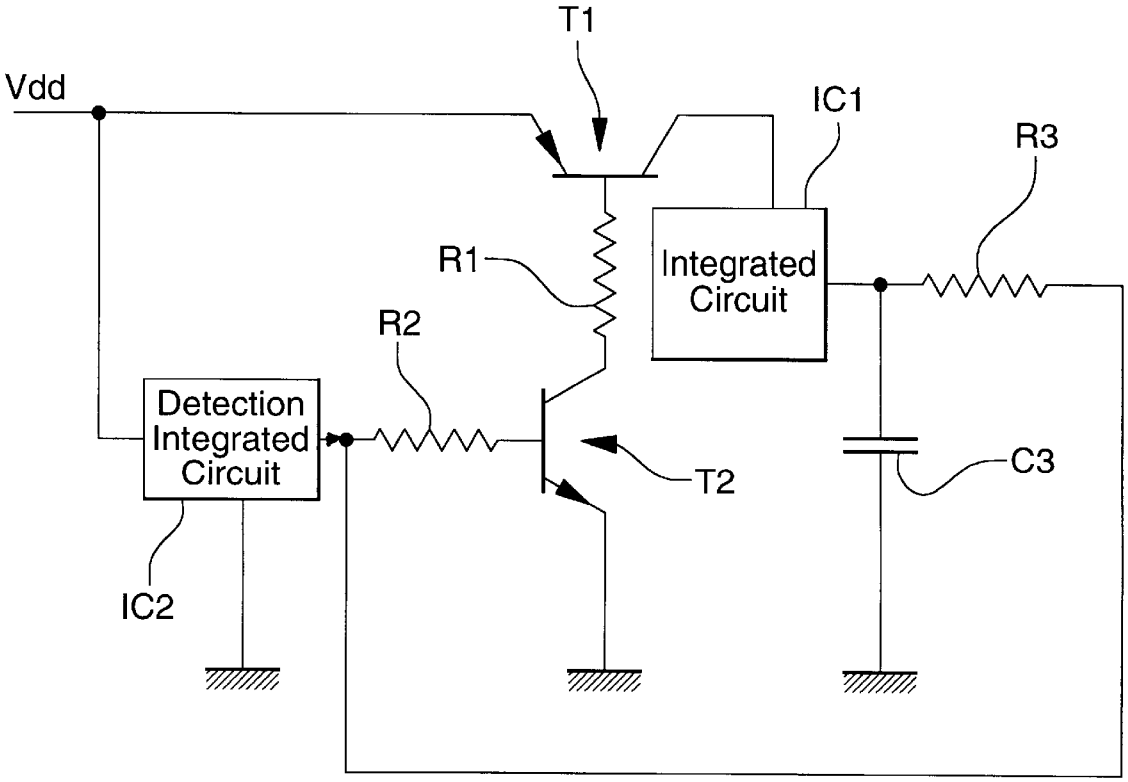
Fig. 1B ( PRIOR ART )
Figure 2:
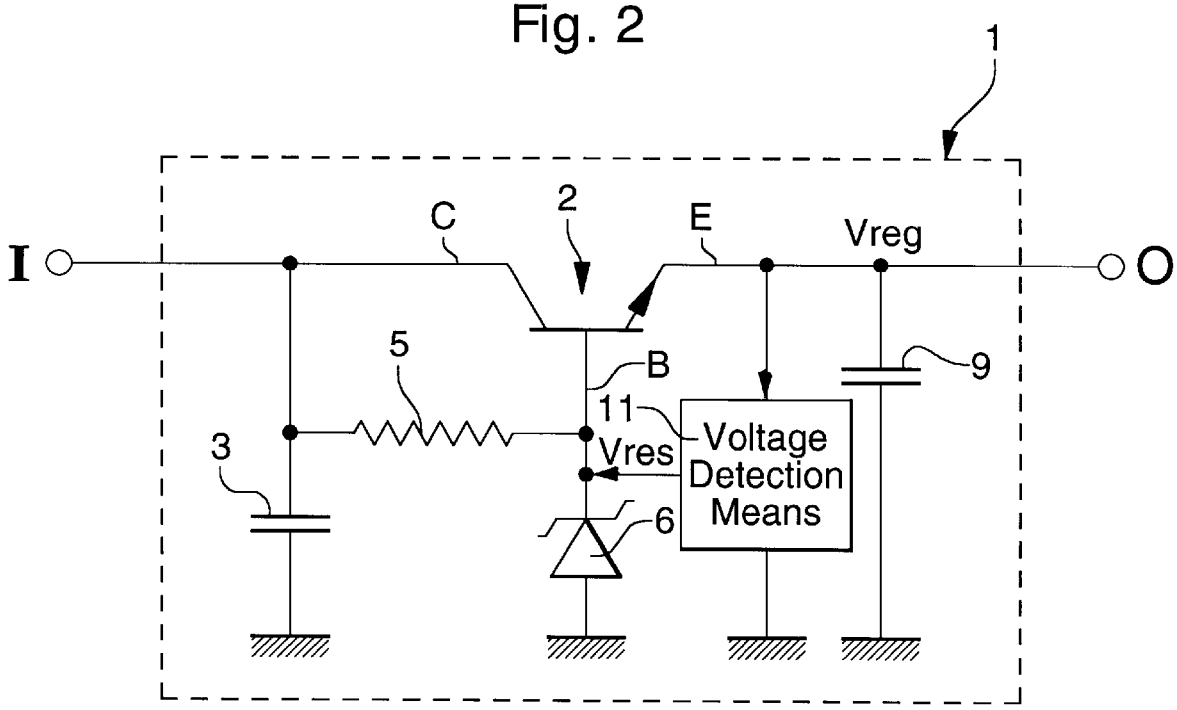
FIG. 2 shows a preferred embodiment of a voltage regulator circuit according to the present invention.

FIG. 2 shows a preferred embodiment of a circuit 1 according to the present invention.

Circuit 1 includes an input terminal I and an output terminal O from which a regulated voltage Vreg has to be supplied, voltage Vreg being supplied so as to be substantially equal to a voltage level Vo. Circuit 1 further includes a bipolar transistor 2, two capacitors 3 and 9, a resistor 5, a Zener diode 6, and voltage detection means 11.

Bipolar transistor 2 typically includes a collector terminal C, an emitter terminal E and a base terminal B, terminals C and E being respectively connected to terminals I and O. Resistor 5 is connected between terminal B and terminal C of transistor 2.

Zener diode 6 is arranged so as to supply a voltage having a value selected so as to form voltage level Vo at output terminal O.

Capacitors 3 and 9 are connected across input terminal I and earth, and across output terminal O and earth respectively. Those skilled in the art will note that capacitor 3 is conventionally used as an interference suppression capacitor, and that capacitor 9 is conventionally used as a smoothing and/or interference suppression capacitor. Capacitor 3 is used only by way of improvement in the present invention has thus not limiting character with respect to the present invention.

Means 11 include an input terminal connected to terminal O, so as to receive at its input voltage Vreg, an earth terminal, and an its output terminal connected to terminal B, so as to supply at output a control voltage Vres to control transistor 2. Means 11 are arranged so that they detect whether voltage Vreg is disturbed by latch-up and, if necessary, command initialisation of this voltage at its initial voltage level Vo, as is explained in more detail hereinafter.

Following numerous experiments, the Applicant of the present invention has established that one of the most efficient solutions for suppressing latch-up in an integrated circuit consists in bringing the level of the supply voltage of the integrated circuit disturbed by said phenomenon to the earth potential, or a sufficient period of time for the circuit to drop below a certain voltage threshold.

For this purpose the voltage regulator circuit of the present invention comprises voltage detection means which, following a "latch up" type disturbance, bring the regulated voltage to the earth potential, thereby eliminating this disturbance.

Figure 3:
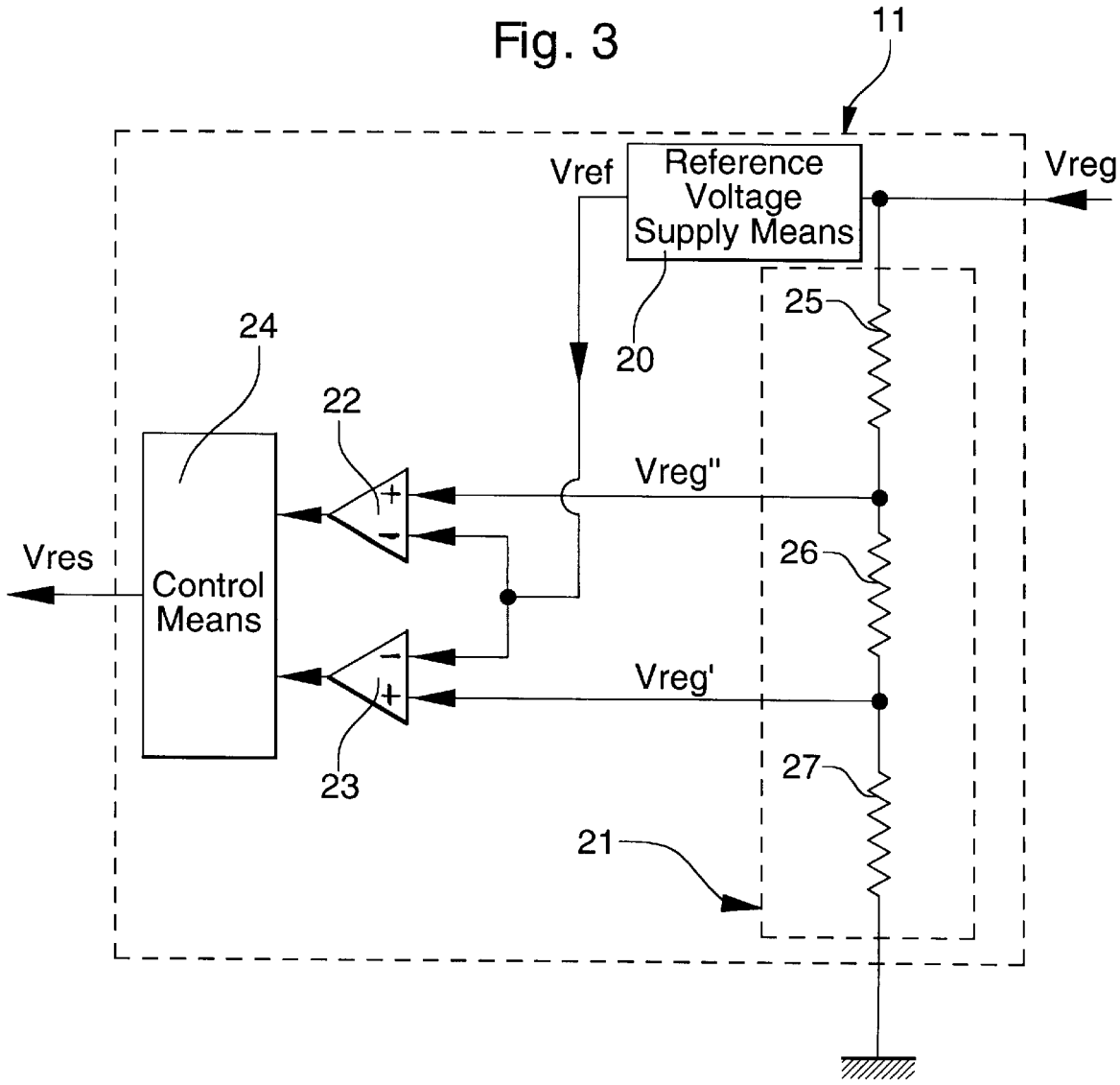
FIG. 3 shows in detail the preferred embodiment of the detection means of the circuit of FIG. 2.

FIG. 3 shows in detail the preferred embodiment of means 11, according to the present invention.

Means 11 includes reference voltage supply means 20 for supplying a reference voltage Vref from voltage Vreg, a voltage divider 21 intended to supply two corrected regulated voltages Vreg' and Vreg" from regulated voltage Vreg, two voltage comparators 23 and 22 for comparing voltage Vref to voltages Vreg' and Vreg" respectively, and control means 24 for supplying, if necessary, voltage Vres capable of controlling transistor 2, and regulating voltage Vreg.

Means 20 include an input terminal connected to the input terminal of means 11 (i.e. to terminal O), so that means 20 receive at its input voltage Vreg, an earth terminal connected to earth, and an output terminal connected to comparators 22 and 23, so that means 20 supply at its output voltage Vref. Means 20 are known in the art, see for example the articles <<CMOS Analog Integrated Circuits Based on Weak Inversion Operation>>, by E. Viftoz et al, IEEE Journal of Solid States Circuits, vol. SC-12, No. 3, June 1977, and <<CMOS Voltage References Using Lateral Bipolar Transistors>>, by M. Degrauwe et al, IEEE Journal of Solid States Circuits, vol. SC-20, No 6, December 1985.

Figure 4:
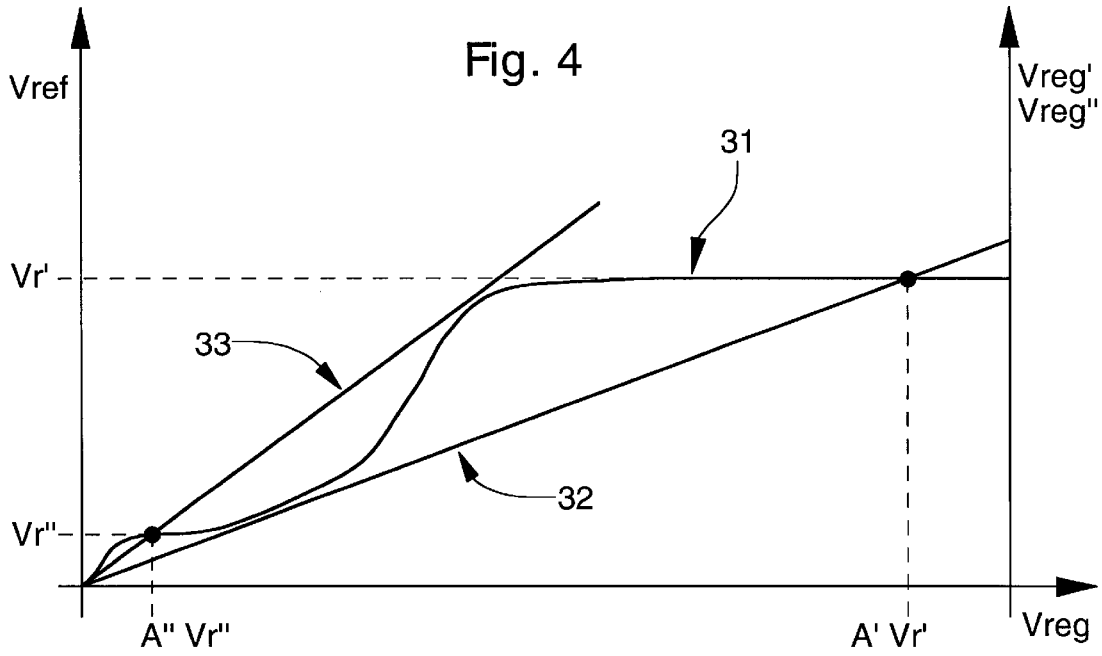
FIG. 4 shows the relationship between three voltages present in the voltage regulator circuit according to the preferred embodiment of the present invention.

The operation of these means will be recalled briefly with reference to FIG. 4. FIG. 4 shows a curve 31 corresponding to the relationship between voltage Vref and voltage Vreg. In this example, means 20 are arranged so that, for a value of input voltage Vreg greater than 1.5 V, output voltage Vref is substantially equal to a voltage threshold V' of the order of 1.2 V, and there exists a voltage level across which voltage Vref is substantially equal to a voltage threshold Vr", for low values of voltage Vreg.

A first voltage level A'Vr' is defined as the voltage level below which a latch-up phenomenon is assumed to occur. In other words, when voltage Vreg drops significantly, a latch-up phenomenon is assumed to be responsible for this drop, as soon as voltage Vreg becomes lower than A'Vr'. A second voltage level A"Vr" is also defined as the voltage level below which a latch-up phenomenon is suppressed. In other words, when there is a drop in voltage Vreg, as is the case when a latch-up phenomenon occurs, this disturbance is suppressed, as soon as voltage Vreg becomes less than A"Vr". Voltage levels A'Vr' and A"Vr" are predetermined values according to the particular specificity of the user's requirements.

In the preferred embodiment shown in FIG. 3, voltage divider 21 is formed by a resistive bridge formed of three resistors 25, 26 and 27 mounted in series between output terminal O and earth. The point of connection between the two resistors 26 and 27 is connected to a first input of comparator 23, so as to provide voltage Vreg' at its input. This voltage is, by definition, proportional to voltage Vreg, the ratio of proportionality, referenced A', being predetermined and dependent upon the values of resistors 27, 26 and 25. By way of illustration, FIG. 4 shows a curve 32 corresponding to the relationship between voltage Vreg' and voltage Vreg. The point of connection between the two resistors 25 and 26 is connected to a first input of comparator 22, so as to provide voltage Vreg" at its input. This voltage is, by definition, proportional to voltage Vreg, the proportionality ratio, reference A", being predetermined and dependent upon the values of resistors 27, 26 and 25. By way of illustration, FIG. 4 shows a curve 33 corresponding to the relationship between voltage Vreg" and voltage Vreg.

Each comparator 23, 22 includes a first input terminal at which is supplied a corrected regulated voltage Vreg', Vreg", respectively, as described hereinbefore, and a second input terminal at which is supplied voltage Vref, as is also described hereinbefore. Thus, comparator 23 compares voltage Vreg' to voltage Vref, while comparator 22 compares voltage Vreg" to voltage Vref. Each comparator 22, 33 further includes an output terminal connected to a respective input terminal of control means 24.

Control means 24 further include an output terminal used as output terminal for means 11, so as to switch voltage Vres, when one of comparators 22, 23 switches, which controls the regulation of voltage Vreg, as will be described in more detail. Means 24 can be formed by a flip-flop known to those skilled in the art, and arranged so as to switch to provide at its output a sufficiently low voltage logic level to set transistor 2 in a blocked state, or a sufficiently high voltage logic level to set transistor 2 in a conducting state, these two logic levels being designated <<0L>>and <<1L>>respectively.

The operation of circuit 1 according to the present invention will now be explained with reference to FIGS. 5A and 5B.

Figure 5A:
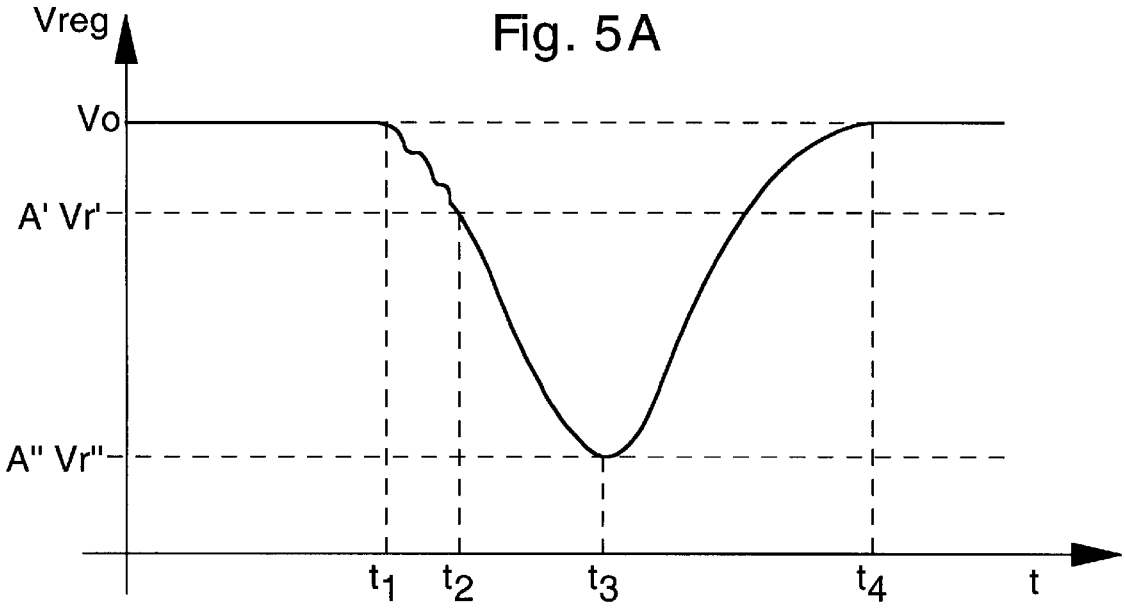
FIGS. 5A and 5B show timing diagrams of the regulated voltage and the signal supplied by the voltage regulator circuit according to the preferred embodiment of the present invention.
Figure 5B:
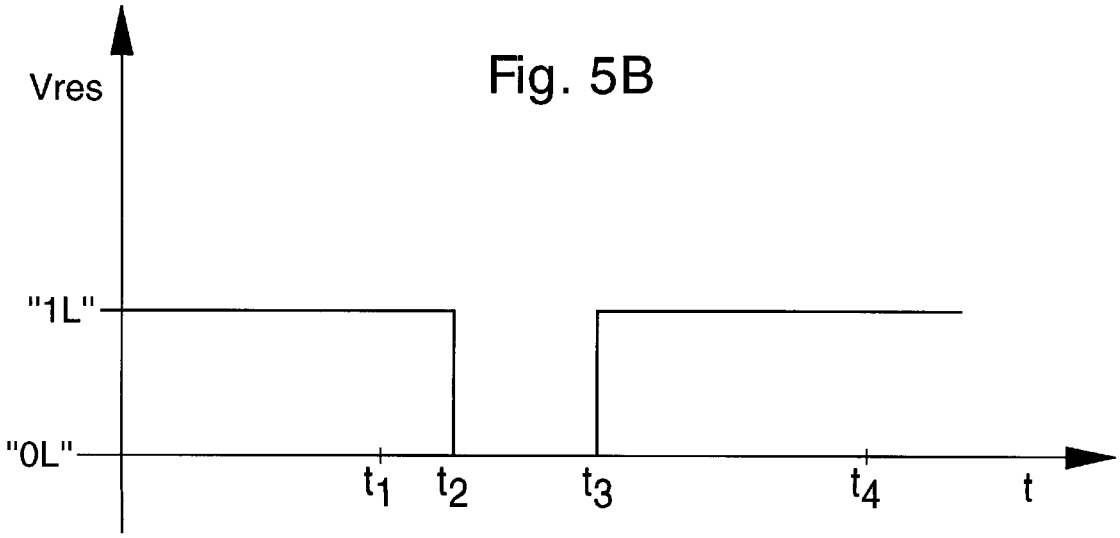

FIGS. 5A and 5B show schematically timing diagrams of voltages Vreg and Vres present in circuit 1 respectively.

When circuit 1 is operating normally, i.e. when it is not disturbed by latch-up, voltage Vreg is substantially equal to voltage level Vo, and voltage detection means 11 supply at its output a logic level <<1L>>as voltage Vres. Consequently, transistor 2 is maintained in a conducting state, so that the voltage across its base and emitter terminals subtracted from the voltage across the terminals of Zener diode 6 is equal to voltage level Vo.

Let us assume that, at an instant t1, a disturbance appears so that voltage Vreg begins to drop significantly below voltage level Vo. This drop continues until an instant t2 when voltage Vreg reaches voltage level A'V', then becomes lower than this level.

A latch-up phenomenon is then declared responsible for loss of control over voltage Vreg. As is shown in FIG. 4, when voltage Vreg becomes lower than voltage level A'Vr', voltage Vreg' (curve 32) becomes lower than voltage threshold V' (curve 31), which causes the switching of comparator 23. As comparator 23 switches, means 24 advantageously bring voltage Vres to <<0L>>, this logic level being sufficient to block transistor 2. The integrated circuit in the condition of the latch-up phenomenon is thus no longer supplied under voltage level Vo. This has the effect of causing voltage Vreg to drop significantly and, consequently, voltage Vref.

This drop continues until an instant t3 when voltage Vreg reaches voltage level A"Vr", then becomes lower than this level. The latch-up phenomenon responsible for the disturbance to voltage Vreg below voltage level Vo at instant t2 is suppressed thereafter. As is shown in FIG. 4, when voltage Vreg becomes lower than voltage level A"Vr", voltage Vreg" (curve 33) becomes lower than voltage threshold Vr' (curve 31), which causes the switching of comparator 22. As comparator 22 switches means 24 advantageously bring voltage Vres to logic level <<1L>>. Since this logic level is sufficient to make transistor 2 conductive, the voltage across its base and emitter terminals increased by the voltage across the terminals of Zener diode 6 is again equal, at an instant t4, to voltage level Vo. The operation of circuit 1 thus returns to normal, until a latch-up phenomenon again disturbs circuit 1, and the situation similar to that at instant t1 is repeated.

It goes without saying for those skilled in the art that the detailed description hereinbefore can undergo various modifications without departing from the scope of the present invention. By way of alternative embodiment, different constant voltage supply means to the Zener diode may be used.

What is claimed is:

1. A voltage regulator circuit for supplying a regulated voltage having a predetermined level, said circuit being able to detect a latch-up phenomenon disturbing said voltage, to suppress said phenomenon and re-establish said voltage at said predetermined level, said circuit including an input terminal and an output terminal from which said regulated voltage is supplied, said circuit including a bipolar transistor having a collector terminal connected to said input terminal, and an emitter terminal connected to said output terminal, a resistor connected across said collector terminal and a base terminal of said transistor, means for supplying a substantially constant voltage at said base terminal of said transistor and voltage detection means connected to said output terminal of said circuit for receiving said regulated voltage, said base terminal of said transistor for supplying a control voltage, and an earth terminal of said circuit, said voltage detection means including further:

reference voltage supply means connected to said output terminal of said circuit for receiving said regulated voltage and said earth terminal of said circuit, said reference voltage supply means supplying a reference voltage capable of being substantially equal to first and second reference voltage thresholds, as a function of the value of the regulated voltage, said first and second thresholds corresponding to first and second predetermined voltage levels, respectively;

a voltage divider connected to said output terminal of said circuit for receiving said regulated voltage and said earth terminal of said circuit, said voltage divider supplying first and second corrected regulated voltages as a function of said regulated voltage;

a first voltage comparator for comparing the first corrected regulated voltage to the first reference voltage threshold, said first voltage comparator being arranged so that it switches when the first corrected regulated voltage becomes lower than said first reference voltage threshold;

a second voltage comparator for comparing the second corrected regulated voltage to the second reference voltage threshold, said second voltage comparator being arranged so that it switches when the second corrected regulated voltage becomes lower than said second reference voltage threshold;

control means receiving output voltages of said comparators and supplying said control voltage to said base terminal of said transistor for controlling the switching of said transistor into a blocked state or a conducting state, said control means being arranged so that the transistor is in said blocked state when a disturbance causes said regulated voltage to drop below a first predetermined voltage level, in which a latch-up phenomenon is defined as being responsible for said disturbance, the switching of said transistor into said blocked state bringing said regulated voltage to the earth potential, and so that the transistor is in said conducting state when said regulated voltage is substantially equal to the predetermined level, i.e. higher than the first predetermined voltage level, or when it is lower than a second predetermined voltage level, the latch-up phenomenon being suppressed below such level.

2. A voltage regulator circuit according to claim 1, wherein said voltage divider further includes first, second, and third resistors connected in series across said input terminal and said earth terminal of said circuit, said first and second corrected regulated voltages being supplied between said first and second resistors, and between said second and third resistors respectively.

3. A voltage regulator circuit according to claim 1, wherein the voltage supply means comprise a Zener diode.

4. A voltage regulator circuit according to claim 1, further comprising a first capacitor connected across said input terminal and said earth terminal of said circuit, said first capacitor being arranged as an interference suppression capacitor.

5. A voltage regulator circuit according to claim 1, further comprising a second capacitor connected across said output terminal and said earth terminal of said circuit, said second capacitor being arranged as an interference suppression and smoother capacitor.

* * * * *